US005937247A

United States Patent [19]

Takeuchi et al.

[11] Patent Number: 5,937,247

[45] Date of Patent: Aug. 10, 1999

[54] GHOSTLESS DEVELOPED IMAGE FORMING APPARATUS AND METHOD

[75] Inventors: Noriyasu Takeuchi, Kanagawa-ken; Masahiko Itaya, Tokyo, both of Japan

[73] Assignee: Ricoh Company Ltd., Tokyo, Japan

[21] Appl. No.: 09/156,414

[22] Filed: Sep. 18, 1998

[30] Foreign Application Priority Data

Sep. 19, 1997 [JP] Japan ..... 9-271905
Oct. 30, 1997 [JP] Japan ..... 9-312880

[51] Int. Cl.[6] ..... G03G 15/10

[52] U.S. Cl. ..... 399/237; 399/249

[58] Field of Search ..... 399/53, 57, 71, 399/222, 223, 224, 225, 231, 237, 239, 249

[56] References Cited

U.S. PATENT DOCUMENTS 5,708,938 1/1998 Takeuchi et al. .

5,805,963 9/1998 Teschendorf et al. ..... 399/249

*Primary Examiner*—Arthur T. Grimley
*Assistant Examiner*—Hoang Ngo
*Attorney, Agent, or Firm*—Oblon, Spivak, McClelland, Maier & Neustadt, P.C.

[57] ABSTRACT

A developing apparatus develops a latent image with a liquid developer includes a developer container capable of containing the liquid developer therein, a developer carrying device that carries the developer thereon and develops a latent image thereon, a developer applying device that applies the developer to the developer carrying device and forms a thin developer layer thereon, and a developer supplying device positioned in contact with the developer applying device and supplies the developer from the developer container to the developer applying device. The developer-supplying device is separated after the developer carrying device develops a latent image, while the developer applying device removes the developer remaining on the developer carrying device.

16 Claims, 5 Drawing Sheets

GHOSTLESS DEVELOPED IMAGE FORMING APPARATUS AND METHOD

BACKGROUND OF THE INVENTION

1. Field of the Invention

The present invention relates to a developing apparatus and method capable of developing a latent image formed on an image carrier with a liquid type developer having high viscosity and density, and in particular, to a developer applying and removing apparatus and a method which forms a thin layer of developer having an almost constant thickness on a developing device in a way that avoids forming "ghost" images during development of the latent image.

2. Description of the Related Art

A conventional developing apparatus used in an image forming apparatus, which develops a latent image formed on the image carrier by an electro-photographic method with liquid type developer having high viscosity and density, is disclosed in Japanese Patent Application Laid Open Nos. 07-239614 and. 08-123205, for example. In the conventional image forming apparatus, a photoconductive (P.C.) surface of an image carrier is uniformly charged by a charge-applying device and then exposed by an image writing device based upon image data, thereby forming a latent image thereon. A liquid type-developing device then develops the latent image. The liquid type-developing device includes liquid type developer composed of dimethyl siloxane oil, for example, having high viscosity and an insulating character, and toner particles dispersed therein in high ratio, which function to make the latent image visible.

The liquid type developer is stored in a developer storing device and is applied to a developing belt or developing roller by a developer applying device to form a thin developer layer having even thickness on a surface of the developing belt or developing roller. The latent image is developed when the developer layer passes through a developing station and the toner therein spreads to the latent image area formed on the P.C. material, thereby forming a visible toner image thereon. The toner image is then transferred onto a copysheet by a transfer device and then fixed on the copysheet by a fixing device. A charge-removing device removes charge remaining on the surface of the P.C. material after transfer of the toner image, and a cleaning device also removes toner remaining thereon, thereby completing an image forming cycle.

However, if a developer layer to be formed on the surface of the developing belt or roller is not even, it causes a density variation of the toner image or non sharpness thereof. Therefore, the developer layer should be evenly formed on the surface of the developing roller.

To apply developer and form a thin developer layer on a developer belt, a developer-applying roller is generally used, as configured in an ink applying system for a duplicating machine. The thin developer layer is spread on a latent image pattern formed on the P.C. drum, but the developer does not spread onto a background portion of the latent image pattern, thereby remaining on the surface of the developer belt.

When new developer is applied onto the surface of the developer belt after a developing operation, a thickness of the developer layer varies between a portion of the surface of the developer belt from which the developer was removed to develop the latent image and a portion in which the developer remains, giving rise to an unevenness of the developer layer. As a result, a ghost, which is an image pattern of an image previously formed, is made when a next latent image is developed by the developing belt having the above-described unevenness of the thickness of the developer layer. To avoid such a ghost, a leveling mechanism that levels ink before duplication is employed in the duplicating machine, for example.

However, since a latent image pattern generally varies somewhat, as does an amount of developer remaining after developing, a thickness of developer correspondingly varies even after leveling thereof by a leveling mechanism. To avoid such a problem, and as presently recognized, developer remaining on the surface of the developing belt should be entirely removed before new developer is applied.

Thus, a special developer-removing roller that removes the developer remaining on the surface of the developing belt is required, and as a result, a developing device is made to be complex. The complexity problem is particularly serious in a full-color image-forming apparatus, since a plurality of the special developer-removing rollers is needed to remove different color developer from the developing belt and so this type of conventional developing device is necessarily bulky.

SUMMARY OF THE PRESENT INVENTION

An object of the present invention is therefore to address and resolve the above-identified and other problems and provide a new liquid type-developing apparatus having a small scale. The present invention includes a developing apparatus capable of developing a latent image with liquid type developer. The developing apparatus has a developer-container capable of containing liquid developer therein, a developer-carrying device, which carries the developer thereon and develops a latent image, a developer applying device, which applies the developer to the developer-carrying device and forms a thin developer layer thereon, and a developer-supplying device, which supplies the developer from the developer container to the developer-applying device. The developer-supplying device is separated from the developer-carrying device after a latent image previously formed is developed on the on the developer-carrying device.

The developer-applying device is constituted by a roller and rotates in a predetermined direction while a contacting surface of the roller contacts the developer-carrying device and moves in opposite direction to that of the developer-carrying device.

The developer-carrying device has a predetermined developing area length that is longer than that of one latent image to be formed on an image carrier.

Further, each of the developer-applying devices and developer supplying devices is constituted by a roller, and a width of the developer applying device is longer than that of the developer supplying device, so that non-developer applied areas (i.e., areas free of developer) are formed at each side edge portions of the contact surface of the developer applying device.

Further, a developing apparatus includes a developer amount-measuring device, which measures a predetermined amount of developer to be supplied from the developer-supplying device to the developer-applying device.

Further, a wire bar having a wire wound therearound or a photogravure roller having a plurality of sculptures on a surface thereof constitutes the developer-supplying roller.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
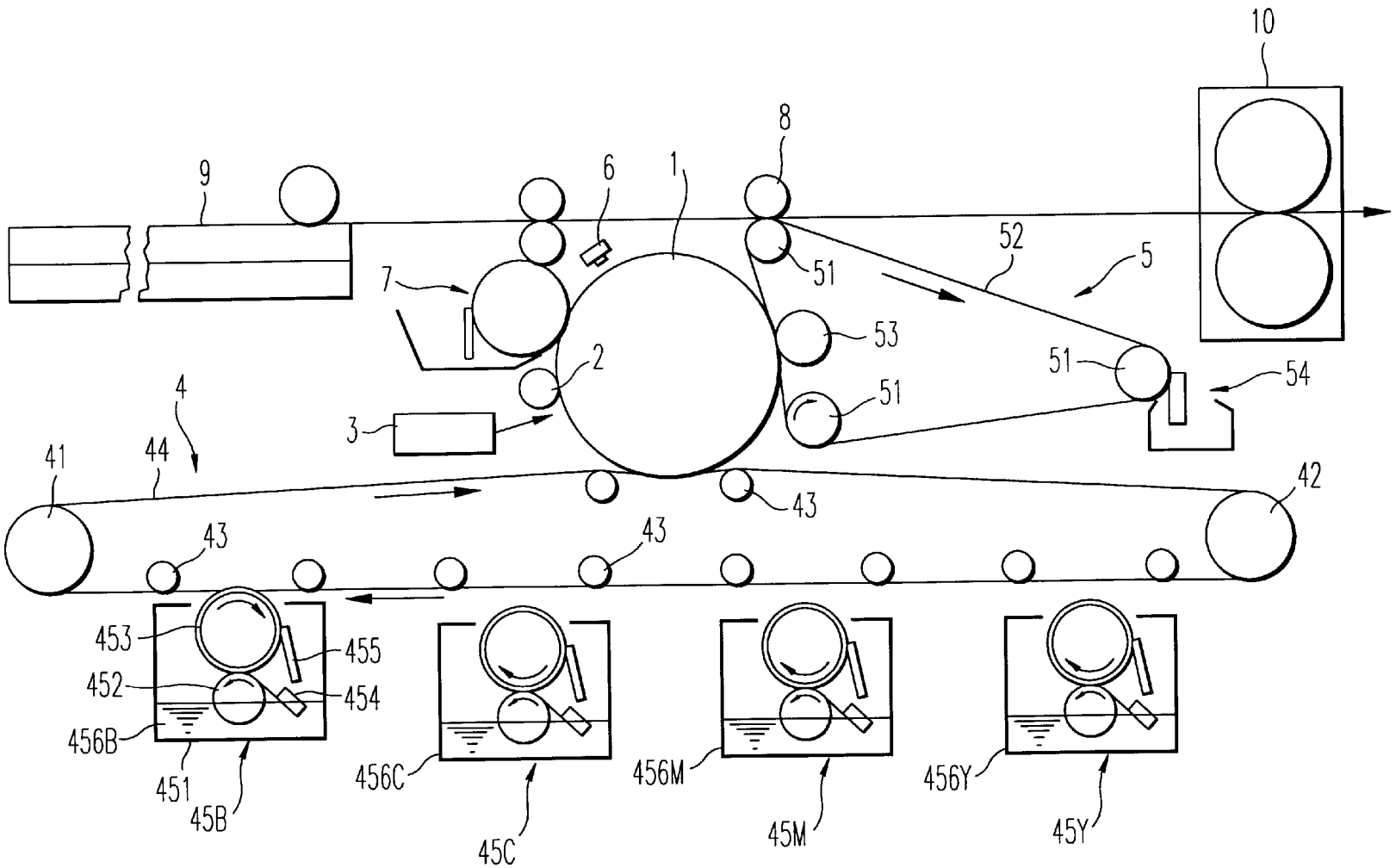
FIG. 1 is a sectional view of a full-color image forming apparatus in which a developing apparatus according to the present invention is employed.

Hereinbelow, embodiments of the present invention are explained referring to the several drawings. A full-color image forming apparatus using a plurality of liquid type-developing devices is illustrated in FIG. 1. As shown in FIG. 1, the apparatus includes a photoconductive drum 1 (hereinafter referred to as P.C. drum 1) rotating counter-clockwise, a charge applying device 2, an optical writing device 3, a liquid type developing device 4, an intermediate transfer device 5, a charge removing device 6, a cleaning device 7, a transfer device 8 disposed beside the intermediate transfer device 5, all being disposed around the P.C. drum 1 along a rotational direction of the P.C. drum 1. The apparatus further includes a sheet feeding section 9 that passes sheets on which images will be printed and fixed on the sheets by a fixing device 10.

The liquid type developing device 4 includes a developing belt 44 wound by a driving roller 41, a driven roller 42 and a plurality of guide rollers 43 and rotates at a same speed in a same direction as the P.C drum 1 at a contact point where the belt contacts the P.C drum 1. The liquid type-developing device 4 further includes a plurality of developer applying units 45B, 45C, 45M, 45Y each for black (B), cyan (C), magenta (M) and yellow (Y) colors. The developing belt 44 has a length longer than a length of an image to be made.

Each of the developer applying units 45B, 45C, 45M, 45Y includes a developer container 451, a developer supplying roller 452, a developer applying roller 453, a developer thickness regulating device 454 and a cleaning blade 455 and is enabled to be selectively positioned in contact with the developing belt 44 by an engaging/disengaging mechanism, not shown. In each of the developer container 451 of the developer applying units 45B, 45C, 45M, 45Y, liquid type developer 456B, 456Y, 456M, and 456C is stored each constituted by a toner solution and toner having different color particles dispersed in a high ratio in the toner solution thereby having high viscosity.

Figure 2:
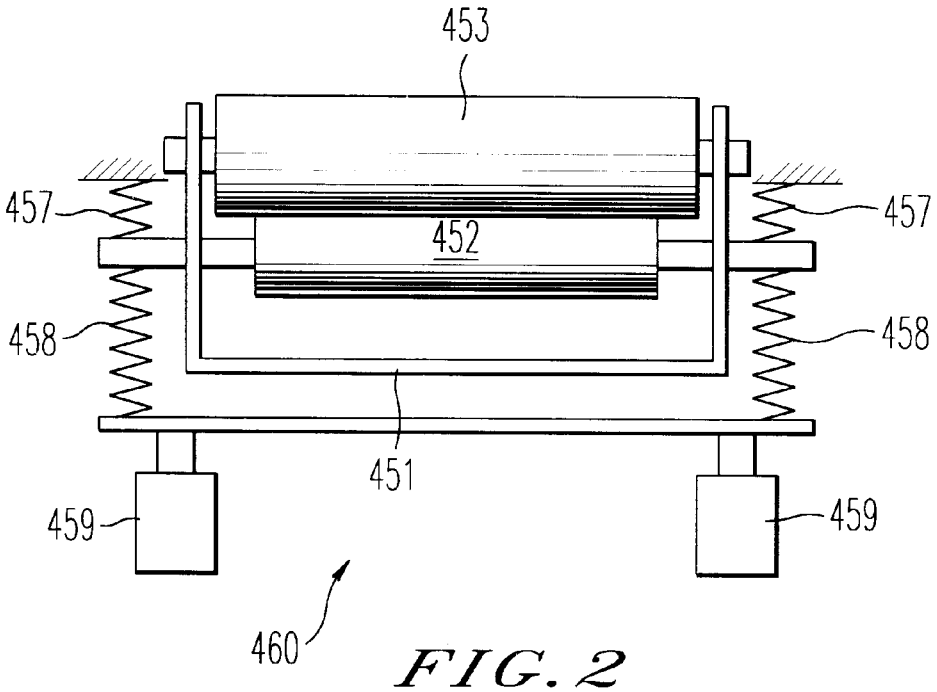
FIG. 2 is a front sectional view of the developing apparatus of shown in FIG. 1.

As shown in FIG. 2, the developer supplying roller 452 is selectively contacted with the developer applying roller 453 by a roller engaging/disengaging mechanism 460 constituted by a pair of springs 457 and 458, a pair of solenoids 459 and so on, and supplies the developer 456 (FIG. 1) stored in the container 451 to the developer applying roller 453 when contacting thereto.

The developer-regulating member 454 (FIGS. 1 and 3), such as for example, a metering blade is employed to regulate the amount of developer to be carried by the surface of the developer-supplying roller 452. The developer-applying roller 453 forms a developer layer on the surface of the developing belt 44 by applying the developer thereon.

The developer-applying roller 453 rotates in a different direction than which the belt 44 moves at a portion of the roller 453 contacts the developing belt 44. The cleaning blade 455 is employed to remove developer attached to the surface of the developer-applying roller 453 after applying the developer to the developing belt 44. The intermediate transfer device 5 shown in FIG. 1 is constituted by the intermediate transfer belt 52, an intermediate transfer roller 53, a belt cleaning device 54 and so on.

The above-described apparatus is operated as described below when an image is to be formed. The surface of the P.C drum 1 is uniformly charged by the charge applying device 2 and a latent image is then formed thereon by exposing the charged surface with a light beam(s) from the optical writing device 3 based upon image data that moderates the light beam(s). The latent image is developed by the liquid type developing device 4 having yellow colored developer 456Y therein so that a yellow toner image is developed and then transferred to the intermediate transfer belt 52.

The charge and toner remaining on the surface of the P.C drum 1 are removed after the toner image is transferred onto the intermediate transfer belt 52 by the charge removing device 6 and the cleaning device 7, respectively. The same operations as described above are repeated for magenta, cyan and black colors, and each of the color images obtained is superimposed on the surface of the intermediate transfer belt 52 so as to form a composite color image. The color image having four colors each superimposed is transferred onto a sheet fed from the sheet feeding section 9 by the transfer device 5, and then permanently fixed onto the sheet by the fixing device 10.

Figure 3:
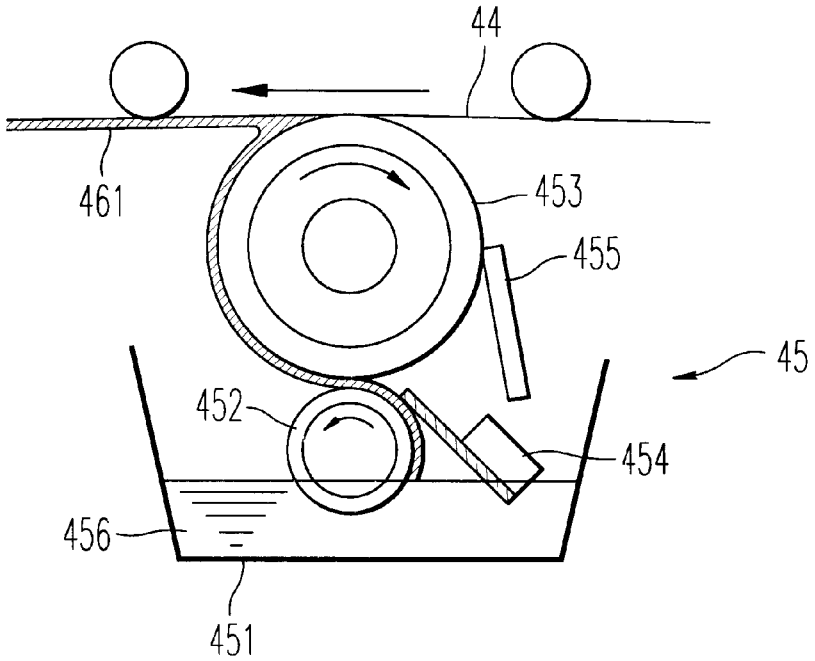
FIG. 3 is a side sectional view of the developing apparatus shown in FIG. 2, and illustrates a condition of applying the developer to a developing belt.

When a latent image formed on the P.C drum 1 is to be developed with black toner (B) by the liquid type developer 456B, only the developer applying roller 453 of the developer applying device 45B is positioned to contact the developing belt 44, and the other developer applying units 45C through 45Y are kept away from the belt 44. When forming a liquid type developer layer on the surface of the developing belt 44 by using the developer applying device 45B, the developer supplying roller 452 contacts the developer applying roller 453 and a predetermined amount of developer 446B is measured out by the regulating device 454 and supplied onto the surface of the developer applying roller 453, as shown in FIG. 3. The developer-applying roller 453 then applies the developer 446B to the surface of the developer belt 44 to form a developer thin layer 461 having a predetermined thickness. The developer thin layer 461 forms a toner image on the surface of the P.C drum 1 corresponding to the latent image pattern by applying toner thereon, when contacting the surface of the PC drum 1. Residual portions of the liquid type developer thin layer 461 remaining on a portion of the developing belt 44, which has passed through the developing station, are then brought into the developer applying unit.

Since the developing belt 44 has a length longer than a (largest) size of one image to be formed, the developing belt 44 completes developing of the latent image formed on the P.C drum 1 before one rotation of the belt 44 is completed after the developer thin layer is first formed on the developing belt 44 by the developer applying-roller 453. Then, the developer-supplying roller 452 is separated from the developer-applying roller 453 to stop supplying developer thereto, when the developer thin layer for one size is formed on the developing belt 44, as shown in FIG. 3. The developer thin layer 461 remaining on the developer belt 44 is removed therefrom by the developer-applying roller 453 to adhere to the surface thereof, when brought in touch with the developer applying-roller 453. The developer on the surface of the developer-applying roller 453 is then removed by the cleaning blade 455 and deposited in the developer container 451.

Figure 4:
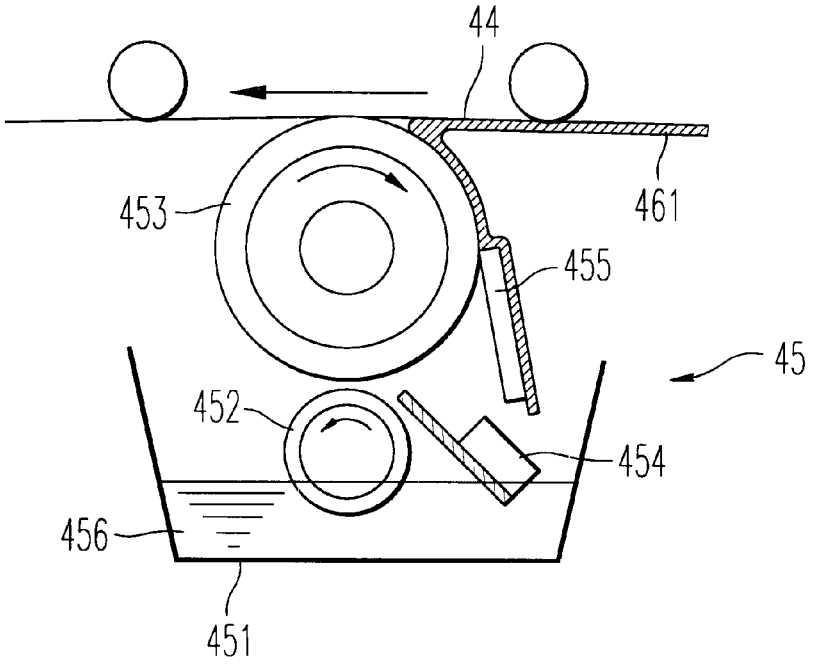
FIG. 4 is a side sectional view of the developing apparatus shown in FIG. 1, and illustrates a condition of removing the developer from the developing belt.

When the developer-applying roller 453 is rotated in a direction as shown in FIG. 4, a portion of the developer-applying roller 453 that contacts the developing belt 44 moves in a direction opposite to developing belt 44 so that the residual portions of the developer thin layer 461 are effectively removed from the developing belt 44 by the developer applying roller 453.

Figure 5:
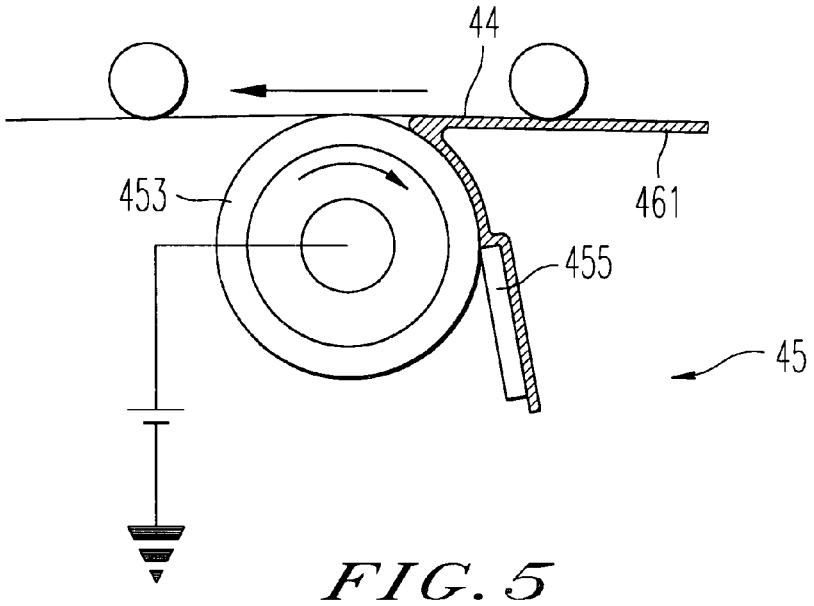
FIG. 5 is a partial sectional view of another developing apparatus having a bias voltage-applying device according to the present invention.
Figure 6:
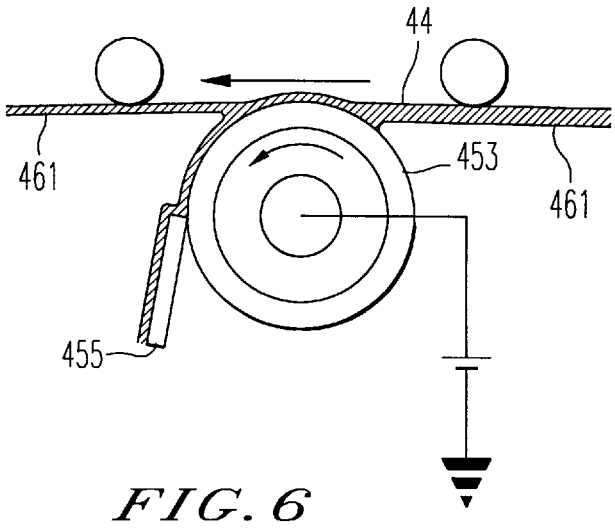
FIG. 6 is a partial sectional view of yet another developing apparatus having a bias voltage-applying device according to the present invention.

When the developer-applying roller 453 is made of material having electrically insulating characteristics and a bias voltage having a polarity opposite to that of the liquid type developer, as shown in FIG. 5, is applied to the developer-applying roller 453, the developer thin layer 461 remaining on the developer belt 44 is more effectively removed from the developing belt 44 by the developer applying roller 453. Regarding rotation direction, when the developer-applying roller 453 is rotated in a direction so that a portion of the developer-applying roller 453 contacting the developing belt 44 moves in a same direction as the developing belt 44 and the bias voltage is applied to the developer-applying roller 453, the developer thin layer 461 remaining on the developer belt 44 is not entirely removed from the developing belt 44 by the developer applying roller 453. However, the developer thin layer 461 is sufficiently removed therefrom, when the developer-applying roller 453 is rotated in a direction so that a portion of the developer-applying roller 453 contacting the developing belt 44 moves in a opposite direction as the developing belt 44 (compare FIGS. 4 and 6).

Since the developer thin layer 461 remaining on the surface of the developer belt 44 after developing is enabled to be removed by the developer applying roller 453 that has formed the developer thin layer 461 beforehand, a special developer removing roller that removes the developer is not required beside the developer applying units 45B through 45Y. Thereby, the constitution of the liquid type developing apparatus 4 can be minimized.

Further, mixture of color of the liquid type developer can be avoided, since the developer thin layer 461 remaining on the surface of the developer belt 44 after developing is removed by the developer applying roller 453 itself. Since one latent image is developed without being divided into a plurality of developing portions thereof, printing efficiency can be enhanced.

Figure 7:
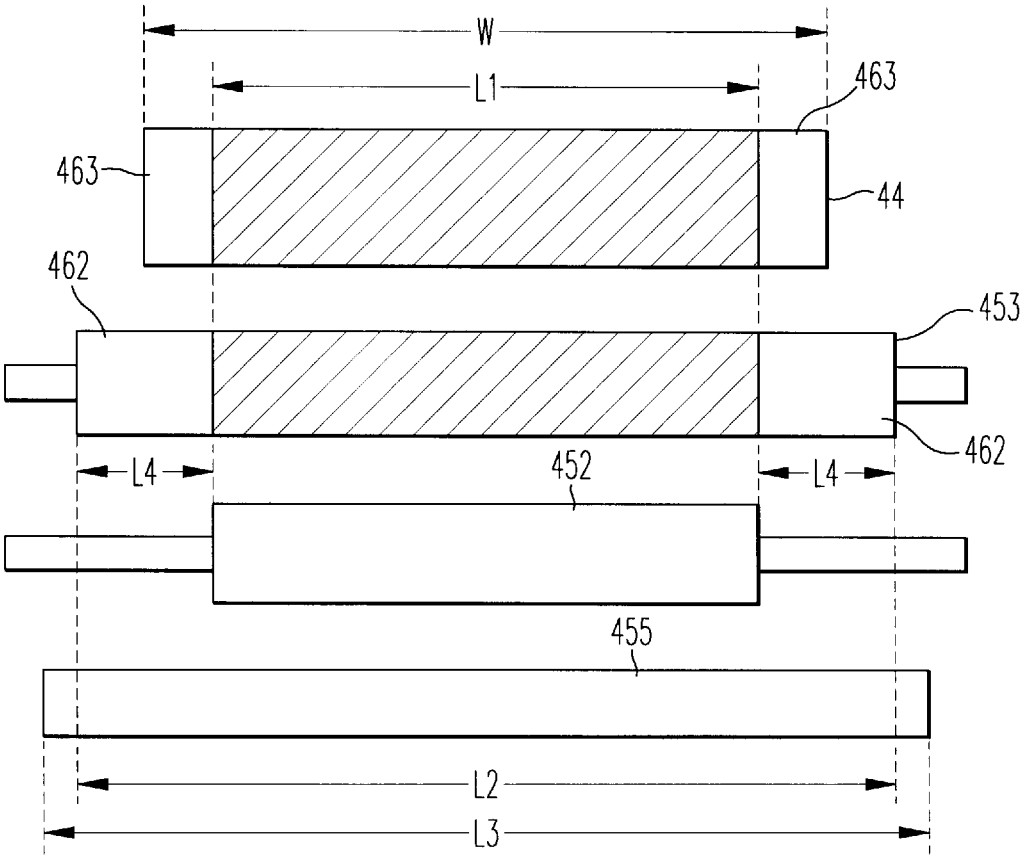
FIG. 7 is a diagram illustrating a width relationship between a developer-applying roller and developer-supplying roller and an arrangement thereof as a typical model.

The width relation among the developer-supplying roller 452 (L1), the developer-applying roller 453 (L2), the developing belt 44 (W) and the cleaning blade 455 (L3) is established to meet the below-described formula, and is shown in FIG. 7. Non developer applied areas 462 having width (L4) of from 10 mm to 20 mm are formed on both edges of the developer-applying roller 453 respectively.

$$L1<W<L2<L3$$

Thereby, a developer thin layer 461 having a predetermined width corresponding to the area beside the non-developer applied areas 462 is formed on the developer belt 44, and accordingly, the residual portion of the developer thin layer 461 remaining on the developer belt 44 can be more efficiently removed after developing. The residual developer of the liquid type developer layer remaining on the developer belt 44 does not spill from each of the edges of the developer belt 44 when removed therefrom, since the non-developer applied areas 462 having width (L4) of from 10 mm to 20 mm are formed on both edges of the developer applying roller 453 respectively.

Further, the developer carried on the developer-applying roller 453 does not spill from both edges thereof, when removed by the cleaning blade 455, since the non-developer applied areas 462 having width (L4) of from 10 mm to 20 mm are formed on each edge of the developer applying roller 453 respectively.

Figure 8:
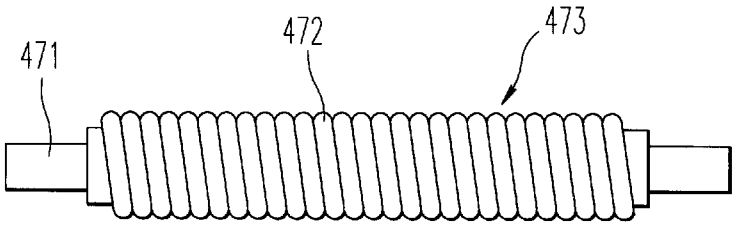
FIG. 8 is a front side view of a wire bar roller as an exemplary developer applying roller that may be used in the developer-applying unit illustrated in FIG. 1.

As shown in FIG. 8 wire bar 473 constituted by a shaft 471 and a thin wire 472 wound around the shaft 471 in a spiral can be used as the developer thickness regulating member 47 for the metering blade portion of the developer thickness regulating device 454.

Figure 9:
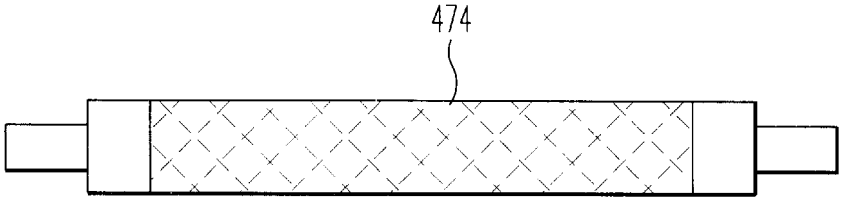
FIG. 9 is a front side view of a photogravure roller as another example of the developer applying roller that may be used in the developer-applying unit illustrated in FIG. 1.
Figure 10:
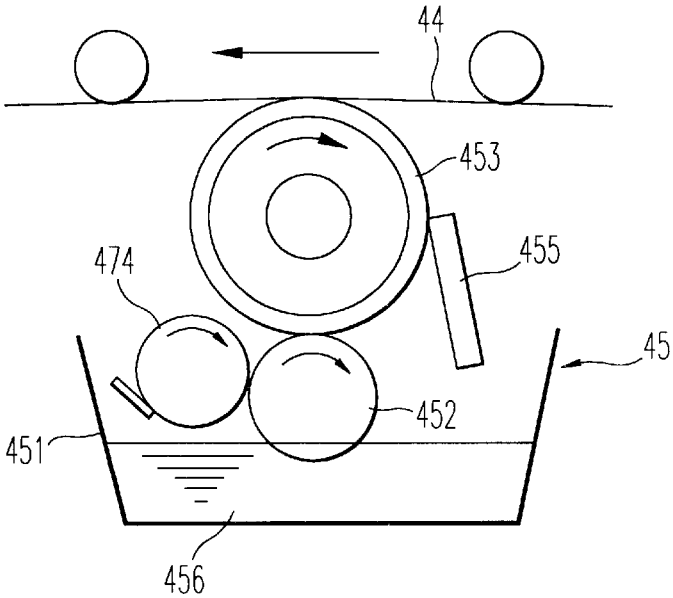
FIG. 10 is a side sectional view of the developer-applying unit using the photogravure roller as a developer-applying roller.

Further, as shown in FIG. 9 and FIG. 10, a photogravure roller 474 having a variety of sculptures on the surface thereof can also be used instead of the member 47 shown in FIG. 8. Each of the rollers 473 and 474 can be separated from the developer-supplying roller 452 by a small distance.

The developer-applying roller 453 rotates in a direction counter to a moving direction of the developing belt 44 as shown in FIG. 10, and accordingly, a fine developer thin layer can be formed on the developer-applying roller 453, even if a wire pattern or a sculpture pattern appears on the developer thin layer when carried on the developer-supplying roller 452.

When a circumferential speed of the developer thin layer is made to be faster than that of the developing belt 44, a more fine developer thin layer can be formed on the developer-applying roller 453. A plurality of developing belts each for developing with different color developer can be used for the above-described developing belt 44 that is used for each of the different color developer units 45B through 45Y.

Further, when a developing roller is used for the developing belt 44, the developer-applying roller can be used in a same manner as described above.

Numerous additional modifications and variations of the present invention are possible in light of the above teachings. It is therefore to be understood that within the scope of the appended claims, the present invention may be practiced other than as specifically described herein.

Teachings in the present document are based on subject matter described in Japanese patent applications JP 9-271905 and JP 9-312880 filed in the Japanese Patent Office on Sep. 19, 1997 and Oct. 30, 1997 respectively, the entire contents of each being incorporated herein by reference.

We claim:

1. A developing apparatus configured to develop a latent image with a liquid developer, comprising:

a developer container configured to hold said liquid developer therein;

a developer carrying device that carries the latent image to be developed by said liquid developer;

a developer applying device positioned to apply a thin developer layer of said liquid developer to said developer carrying device; and a developer supplying device disposed in contact with said developer applying device and configured to supply said developer from said developer container to said developer applying device during a developing operation, wherein, said developer supplying device being separated from said developer applying device after said latent image has been developed on said developer carrying device during said developing operation.

2. A developing apparatus as claimed in claim 1, wherein:

said developer applying device includes a roller that rotates in a predetermined direction, a contacting surface of said roller configured to contact said developer carrying device, which moves in a direction opposite to the predetermined direction, during the developing operation.

3. A developing apparatus as claimed in claim 1, wherein:

said developer carrying device has a predetermined developing area having a length longer than that of the latent image.

4. A developing apparatus as claimed in claim 1, wherein:

said developer applying device and said developer supplying device being rollers, a width of said developer applying device being longer than a width of said developer supplying device, so that non-developer applied areas are formed at each side edge portion of said developer applying device.

5. A developing apparatus as claimed in claim 1, further comprising:

a developer amount-measuring device configured to measure a predetermined amount of developer supplied from said developer-supplying device to said developer applying device.

6. A developing apparatus as claimed in claim 4, wherein:

said roller of said developer supplying device comprises at least one of a wire bar having a wire wound therearound and a photogravure roller having a plurality of sculptures formed on a surface thereof.

7. An image forming apparatus comprising:

a photo-conductive member configured to carry a latent image thereon;

a latent image forming device configured to form said latent image on said photo-conductive member;

a developing device, which develops said latent image with a liquid developer to form a toner image;

a transfer device configured to transfer the toner image from said photo-conductive member onto a sheet, wherein, said developing device includes, a developer container configured to hold said liquid developer therein, a developer carrying member that carries said latent image developed with said developer, a developer applying member positioned to apply a thin developer layer of said liquid developer to said developer carrying member, and a developer supplying member disposed in contact with said developer applying member and configured to supply said liquid developer from said developer container to said developer applying member during a developing operation and configured to be separated after said latent image is developed on said developer carrying member.

8. An image forming apparatus as claimed in claim 7, wherein:

said developer applying member includes a roller that rotates in a predetermined direction, a contacting surface of said roller configured to contact said developer carrying member which moves in a direction opposite to the predetermined direction.

9. An image forming apparatus as claimed in claim 7, wherein:

said developer carrying member has a developing area having a predetermined length longer than that of the latent image.

10. An image forming apparatus as claimed in claim 7, wherein:

said developer applying member and said developer supplying member being rollers, a width of said developer applying member being longer than a width of said developer supplying member, so that non-developer applied areas are formed at each side edge portion of said developer applying member.

11. An image forming apparatus as claimed in claim 7, further comprising:

a developer amount-measuring member configured to measure a predetermined amount of liquid developer supplied from said developer supplying member to said developer applying member.

12. An image forming apparatus as claimed in claim 7, wherein:

said developer supplying member includes at least one of a wire bar having a wire wound therearound and a photogravure roller having a plurality of sculptures formed on a surface thereof.

13. A developing method, comprising the steps of:

supplying a liquid developer from a developer container to a developer applying device;

applying said liquid developer to a developer carrying device by said developer applying device while contacting said developer carrying device;

forming a developer thin layer of said liquid developer on said developer carrying device;

developing a latent image with said developer thin layer formed on said developer carrying device;

separating said developer supplying device from said developer applying device; and removing residual developer remaining on said developer carrying device by said developer applying device.

14. A developing method as claimed in claim 13, further comprising the step of:

rotating said developer applying device in a direction counterclockwise to a moving direction of said developer carrying device, when removing said developer from said developer carrying device.

15. A developing method as claimed in claim 13, further comprising the steps of:

measuring a predetermined amount of developer before supplying said developer from said developer applying device.

16. A developing apparatus, comprising:

means for supplying liquid developer from a developer container to a means for applying the liquid developer;

said means for applying the liquid developer being for applying the liquid developer to a developer carrying device when contacting the developer carrying device;

means for forming a developer thin layer of said liquid developer on said developer carrying device;

means for developing a latent image on said developer carrying device with said developer thin layer;

means for separating said means for supplying from said means for applying; and means for removing residual developer remaining on said developer carrying device by said means for applying.

* * * * *